United States Patent [19]

Crittenden

[11] Patent Number: 4,969,861

[45] Date of Patent: Nov. 13, 1990

[54] APPARATUS FOR SQUARING SLEEVES

[75] Inventor: Bradley J. Crittenden, Burnaby, Canada

[73] Assignee: MacMillan Bloedel Limited

[21] Appl. No.: 416,573

[22] Filed: Oct. 3, 1989

[51] Int. Cl.[5] ..... B31C 1/06; B31B 9/78; B31B 17/74

[52] U.S. Cl. ..... 493/102; 493/295; 493/303; 493/309

[58] Field of Search ..... 493/84, 89, 102, 113, 493/114, 295, 303, 308, 309

[56] References Cited

U.S. PATENT DOCUMENTS

| | | | |
|---|---|---|---|
| 852,083 | 4/1907 | Smith | 493/114 |
| 1,218,683 | 3/1917 | Milmoe | 493/309 |
| 1,219,427 | 3/1917 | Beckmann | 493/309 |
| 2,616,233 | 11/1952 | Schenk | 493/309 |
| 2,696,612 | 12/1954 | Rickus | 493/102 |
| 2,704,179 | 3/1955 | Wilcox | 493/102 |
| 3,162,100 | 12/1964 | Rein et al. | 493/102 |
| 3,416,413 | 12/1968 | Hill | 493/102 |
| 3,634,995 | 1/1972 | Curtis | 493/102 |
| 3,659,505 | 5/1972 | Wasyluka et al. | 493/102 |
| 4,127,977 | 12/1978 | Roehn | 53/565 |
| 4,441,948 | 4/1984 | Gillard et al. | 156/189 |
| 4,457,744 | 7/1984 | Sanford | 493/126 |
| 4,530,692 | 7/1985 | Williams | 493/309 |
| 4,601,407 | 7/1986 | Gillard | 220/443 |
| 4,798,571 | 1/1989 | Everman et al. | 493/114 |
| 4,830,271 | 5/1989 | Lau et al. | 229/117 |

*Primary Examiner*—William E. Terrell

[57] ABSTRACT

An apparatus for squaring a sleeve having at least one pair of opposed bevelled corners comprises a cradle having sleeve supporting members merging towards an apex but terminating spaced from the apex and having a support beam in the space between the members and the apex. The support members and support beam are arranged to conform with the outside shape of the sleeve in squared condition. An platen is moveable into a sleeve while the sleeve is supported in the cradle. The platen is shaped to substantially conform with the inside of the sleeve in squared condition and is moveable toward the apex to force the sleeve into conformity with the cradle and the support member and thereby square the box. Preferably an end closure pad applicator will apply an end closure pad to the squared sleeve while supported in the cradle and with the platen in place to resist pressure applied to the outside of the sleeve when the pad is being secured to the sleeve.

8 Claims, 3 Drawing Sheets

FIG.3.
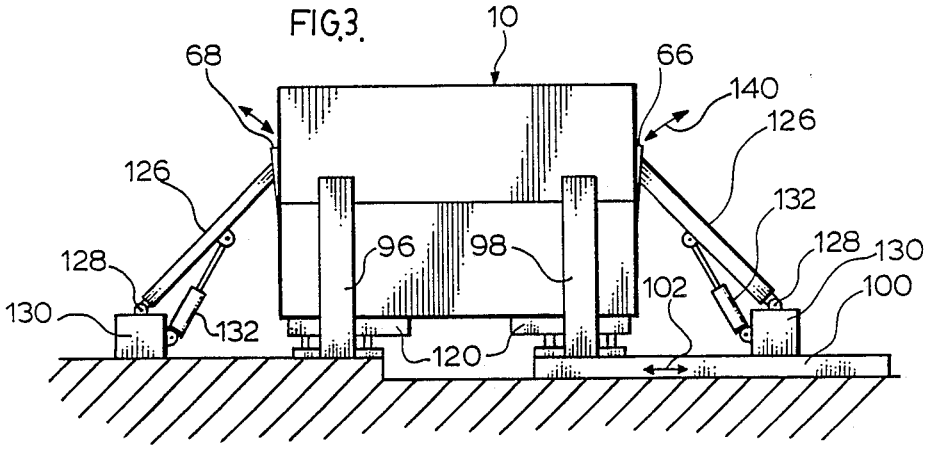
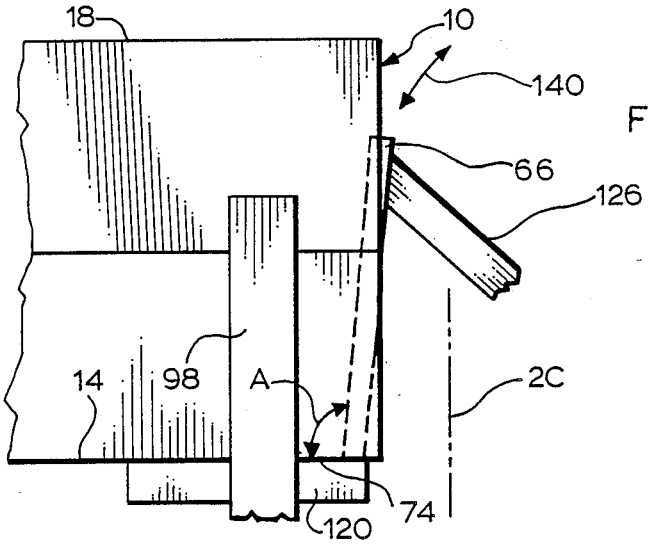
FIG.4.
FIG.5.
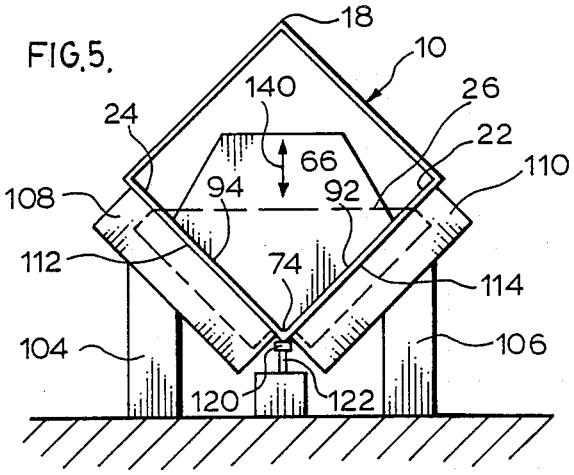

APPARATUS FOR SQUARING SLEEVES

FIELD OF THE INVENTION

The present invention relates to an apparatus for squaring of a carton or sleeve. More particularly the present invention relates to an apparatus for squaring a sleeve having bevelled corners and for applying a partial end closure pad to the open end of the sleeve while supporting the sleeve in squared position.

BACKGROUND OF THE PRESENT INVENTION

The present invention is particularly applicable to multi-layered containers of the type described in U.S. Pat. No. 4,601,407 issued July 22, 1986 to Gillard. This patent describes a multi-layered container formed preferably by winding a single face corrugated medium convolutely around a mandrel using the method described in U.S. Pat. No. 4,441,948 issued Apr. 10, 1984 to Gillard et al. Preferably the sleeve on at least two opposed corners will be bevelled and each of the corners will be crushed as the single face is wound to form the sleeve.

The bevelled corner presents a difficulty in ensuring that each bevelled corner conforms with the intended shape of the bevelled corner, i.e. insure that the bevel surface in the corner is symmetrical with respect to the adjacent side walls of the sleeve (angles between bevel surface and each adjacent side be equal) and that the bevel in the corner is not laterally displaced thereby changing the configuration of the squared container. This problem may be encountered in any similar bevelled corner type container having a relatively wide corner formed for example by two spaced fold lines with an intermediate section therebetween it being necessary to ensure that the two adjacent side walls fold relative to the intermediate or bevelled section on their adjacent fold lines and be symmetrical relative to the bevelled section.

When an end closure pad having flaps adapted to be secured to the outside of the walls of the container is applied to a squared container it is sometimes necessary to support the sleeve from the inside to resist pressure applied from the outside holding the flaps against the outside of the wall of the sleeve until they are secured into position. No suitable means for so supporting the inside of the container appear to exist.

One type of end closure is disclosed in U.S. Pat. No. 4,830,271 issued May 16, 1989 to Lau et al and is formed of a pair of discrete pad elements one being applied on one pair of adjacent sides of an open end of the box and another to the opposite pair of adjacent sides. Flaps on the elements are secured to the outside of the side walls of the sleeve.

Various apparatuses for applying end closures to sleeves or boxes have been proposed however none have been particularly adapted to apply the closure pads of the type described in said U.S. Pat. No. 4,830,271 to the ends of the sleeve such as of the type described in U.S. Pat. No. 4,601,407.

U.S. Pat. No. 852,083 issued Apr. 30, 1907 to Smith and U.S. Pat. No. 3,659,505 issued May 2, 1972 to Wasyluka et al disclose systems for applying end walls to tray type containers wherein the end walls have flaps that are secured to the adjacent walls of the container. U.S. Pat. No. 3,069,980 issued Dec. 25, 1962 to Kendall et al; U.S. Pat. No. 3,416,413 issued Dec. 17, 1968 to Hill and U.S. Pat. No. 4,798,571 issued Jan. 17, 1989 to Everman et al all disclose systems for applying an end pad to close a tubular sleeve. However none of these arrangements teach squaring of a container by application of an interior platen and supporting of the inside of the container or sleeve during the application of the end closure pads.

BRIEF DESCRIPTION OF THE PRESENT INVENTION

It is an object of the present invention to provide an apparatus for squaring cartons or sleeves for forming cartons and having bevelled corners by applying forces to the inside of the carton or sleeve to conform the carton into a predetermined shape as defined by a supporting structure.

It is a further object of the present invention to provide a system for squaring a carton having a pair of opposed bevelled corners and applying an end closure pad to the end of the carton while supported from the inside to prevent deformation of the side walls of the sleeve during application of the end pad.

Broadly the present invention relates to an apparatus for squaring a sleeve formed with at least one pair of opposed bevelled corners each interconnecting a pair of adjacent side walls of said sleeve, said apparatus comprising a cradle having supporting members converging toward an apex at substantially the same angle as said side walls of a pair of adjacent side walls interconnected by one of said bevelled corners converge when said sleeve is in squared condition, said members terminating spaced from said apex to provide a space, an anvil in said space between said apex and said members, said anvil being in position to engage said one of said bevelled corners when said sleeve is in said cradle, an platen member, means for moving said platen member into said sleeve and into said one bevelled corner when said sleeve is in said cradle, said platen member having an outer periphery conforming with the shape of the inside of said sleeve around said one bevelled corner when said sleeve is in said squared condition, said means for moving said platen into said one bevelled corner to force said one bevelled corner into face to face relationship with said anvil and each of said pair of adjacent side walls into face to face relationship with its adjacent said support member thereby to square said sleeve.

Preferably said platen member is positioned adjacent one axial end of said sleeve and means is provided for applying an end closure pad to said open end of said sleeve when said sleeve has been squared and is clamped between said cradle and said platen.

Preferably said end closure pad is provided with flaps and said means to apply said end closure pad includes flap folding wings moveably mounted to force said flaps one against an outside surface of each of said pair of adjacent side walls and said platen member is positioned adjacent said axial open end of said sleeve in position to support each of said pair of adjacent side walls from inside of said sleeve when said flaps are forced against said outside of said side walls.

Preferably said means to move moves said platen into and out of said sleeve on a path that does not significantly interfere with an end closure pad after it is applied to the adjacent said open axial end of said sleeve.

Preferably said sleeve is supported adjacent both its axial ends in said cradle and two of said platens are provided one adjacent each axial end of said sleeve and said means to move moves both said platens into said bevelled corner one adjacent each axial end of said sleeve to square said sleeve.

BRIEF DESCRIPTION OF THE DRAWINGS

Further features, objects and advantages will be evident from the following detailed description of the preferred embodiments of the present invention taken in conjunction with the accompanying drawings in which.

FIG. 3 shows a second system for carrying out the present invention.

FIG. 4 is a side view of one end of the system illustrated in FIG. 3.

FIG. 5 is an end view of the devices shown in FIG. 4 with parts omitted and the end closure pad shown in phantom lines.

DESCRIPTION OF THE PREFERRED EMBODIMENTS

Figure 1:
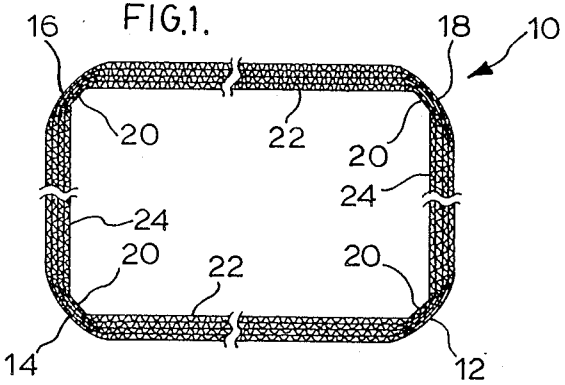
FIG. 1 is a cross section through a box or sleeve specifically intended to be squared using the present invention.

In FIG. 1 a typical sleeve 10 to be squared using the present invention is illustrated in cross section. In the illustrated sleeve all of the corners 12, 14, 16 and 18 are shown as bevelled corners wherein a connecting surface 20 interconnects the inner surface of a pair of adjacent walls. Only one pair of opposed corners are normally squared in the illustration corners 14 and 18 and the walls 22 and 24 from the adjacent pairs of walls positioned on opposite sides of each of the diagonally opposed bevelled corners 14 and 18.

Figure 1A:
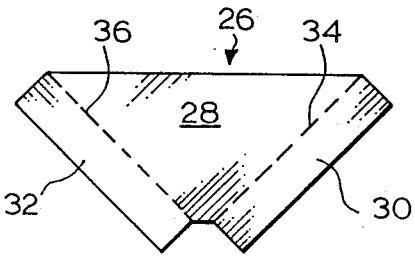
FIG. 1A is a plan view of a blank for forming an end closure pad suitable for application to the sleeve of FIG. 1.
Figure 6:
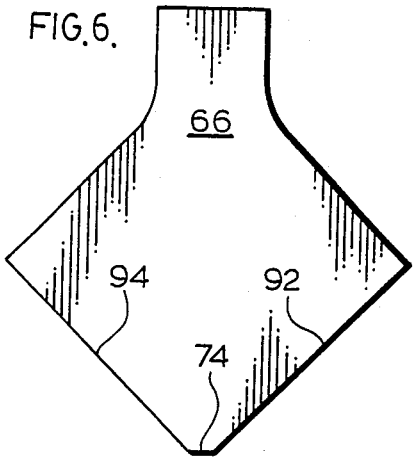
FIG. 6 is a plan view of a suitable platen.

Closure pads such as the closure pad 26 shown in FIG. 1A may be applied to close the axial ends of the sleeve 10 there being two such pads 26 applied at each axial end of the sleeve 10, one to each diagonal opposite corner, e.g. corners 14 and 18 at each axial end of the sleeve to close each axial end. The pad 26 is composed of a main triangular panel 28 which in the pad illustrated is a right angle triangle to match with the right angle corner formed by the corners 14 and 18. The panel 28 has flaps 30 and 32 connected thereto on opposite sides of the right angle corner of panel 28 via fold lines 34 and 36 respectively. These flaps 30 and 32 are adapted to be secured to the outer surface of a pair of adjacent side walls of the container or sleeve 10, i.e. the side walls 22 and 24.

Figure 2:
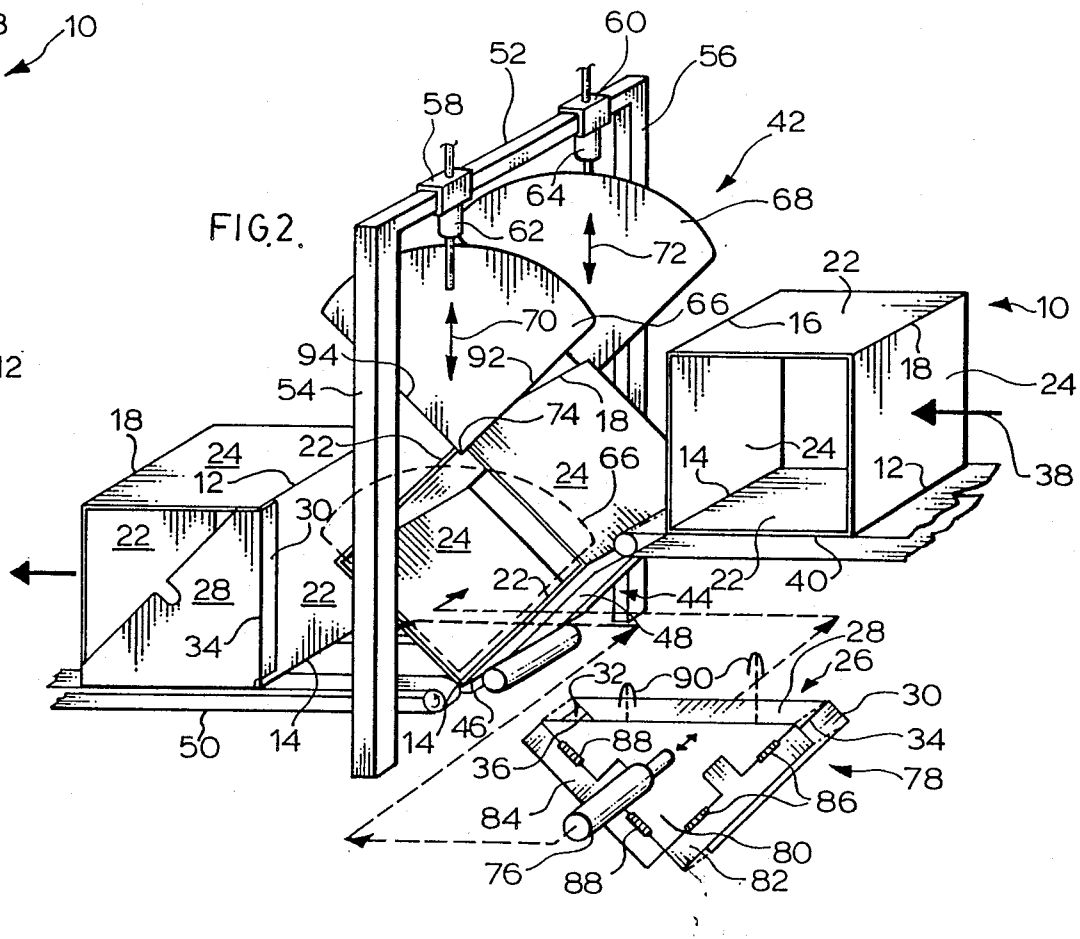
FIG. 2 is a schematic illustrating one system for squaring a sleeve and applying partial end closure pads to the axial open ends thereof.

In the schematic arrangement shown in FIG. 2 a sleeve 10 enters at the right hand side and moves in the direction of arrow 38 on conveyer belt 40 into the squaring and pad application station schematically illustrated at 42. The sleeve 10 falls into a cradle generally indicated at 44 so that the bevelled corner, in the illustration corner 14, moves against an anvil 46 while wall 22 is supported on cradle support member 48 and wall 24 on the opposite side of the fold 14 is supported on a similar cradle support member (not shown). The similar support member is moveable from a supporting position supporting the wall 24 in a squaring position substantially perpendicular to the wall 22 to a lowered position permitting the entire box to be carried via the conveyer 50 into a second squaring and pad applicating station which will be substantially the same as the station 42. The conveyer 50 carries the sleeve 10 after the first pair of pads 26 have been applied one to each axial end of the sleeve 10 into the second station (not shown) i.e. the conveyor 50 functions in the second station in a manner substantially equivalent to the conveyer 40 in the illustrated station 42 it being recognized that to square the corner 18 the sleeve 10 must first be rotated through 90° by a suitable tipping means (not shows).

A cross support bar 52 supported on a pair of pillars 54 and 56 mounts a pair of adjustable support elements 58 and 60 whose position is adjustable along the bar 52 (axially of the sleeve 10). These support elements 58 and 60 mount piston and cylinder mechanisms 62 and 64 which in turn support platens 66 and 68 respectively. The piston and cylinder 62 and 64 move the platens 66 and 68 respectively as indicated by the arrows 70 and 72 down into the sleeve 10 when it is supported in the cradle 44. The directions of movement of the platens 66 and 68 are not vertical but are sloped axially inward relative to the axial end of the sleeve 10 into which it is to be projected so that the leading edge 74 project into the sleeve 10 when the platens 66 and 68 are lowered to the lower position as indicated in dash lines. The platens 66 and 68 and their function will be described in more detail with respect to the embodiment of FIGS. 3 to 7 inclusive which operates in essentially the same manner and includes essentially the same elements as the system illustrated in FIG. 2.

Mounted on the pillar 54 via a piston and cylinder 76 is a pad applicator 78 adapted to apply an end pad such as the pad 26 to the adjacent axial open end of the squared sleeve 10. The applicator 78 has a main plate 80 that has a substantially triangular configuration matching essentially the triangular panel 28 of the blank 26 and includes a pair of wings 82 and 84 foldably connected thereto by any suitable means such as the hinges indicated at 86 and 88 respectively so that the wings may be pivoted from a position planar with plate 80 to a position extending substantially perpendicular to the plate 80 by means (not shown) thereby to fold the flaps 30 and 32 against the outer faces of the walls 22 and 24 respectively. In the illustrated arrangement suitable clips schematically indicated at 90 are used to clip the blank 26 in face to face relationship with the applicator 78 so that the triangular portion 28 is in face to face relationship with the plate 80 and the flaps 30 and 32 are in face to face relationship with the wings 82 and 84 respectively.

Only one applicator 78 has been shown but obviously there will be one such applicator at each axial end of the sleeve 10 if pads 26 are to be provided on both axial ends of the sleeve.

In operation, using the embodiment of FIG. 2, the sleeve 10 falls into the cradle 44 and tends to partially square itself by its own weight with the corner 14 abutting on the anvil 46 and the side walls 22 and 24 lying against the support 48 and the other cooperating support (not shown). The platens 66 and 68 are then lowered into the inside of the sleeve at each axial end of the sleeve 10 to force the corner 14 against the anvil 46 and the side walls 22 and 24 against their respective support members 48 and other support (not shown) thereby to square the sleeve. If a pad is to be applied to the end of the sleeve a suitable pad blank 26 is clipped onto the applicator 78 via clips 90 and the piston cylinder 76 actuated to force the blank 26, in particular the triangular panel 28, against the axial ends of the walls 22 and 24 and then the wings 82 and 84 are moved into a position substantially perpendicular to the plate 80 to fold the flaps 30 and 32 into face to face relationship with the side walls 22 and 24. A suitable adhesive is preapplied either to the flaps 30 and 32 or to the outside of the walls 22 and 24 so that the flaps 30 and 32 are secured to the outside of the walls 22 and 24. The platen 66 (and 68) has a pair of side walls 92 and 94 that engage the inside of the walls 22 and 24 and force them against their supports 48. These edges 92 and 94 are positioned close to the open axial ends of the sleeve 10 in a position to resist deflection of the walls 22 and 24 inwardly by the pressure applied via the wings 82 and 84 which fold the flaps 30 and 32 against the outside of the walls 22 and 24 respectively. Obviously if a pad 26 is to be applied to the opposite axial end of the sleeve the applicator for that pad and the platen 68 will function in a similar manner.

The arrangement shown in FIGS. 3 to 5 inclusive is similar to FIG. 1. The platens 66 and 68 are however, not supported on a cross member 52 via pistons and cylinders, but each is supported on a pivoting arm 126 as will be described hereinbelow.

In the arrangement of FIG. 3 the cradle is different from the cradle of FIG. 1 and is formed by a fixed v-shaped support 96 and a moveable v-shaped support 98 that is moveable on a carriage 100 as indicated by the arrow 102 so that the spacing between the cradles supports 96 and 98 and between platens 66 and 68 may be adjusted to accommodate sleeves 10 of different axial lengths.

The supports 96 and 98 are essentially the same and each comprises a pair of pillars 104 and 106 (see FIG. 5) having support members 108 and 110 mounted thereon. The cradle support members 108 and 110 are provided with surfaces 112 and 114 that converge towards an apex as indicated at 116 in FIG. 7 but terminate before reaching the apex to define a space 118 between the apex and the termination of the support members 108 and 110. An anvil 120 substantially equivalent to the anvil 46 in the FIG. 2 embodiment is positioned within the space 118.

In the illustrated arrangement the anvil 120 is supported on an adjustable support 122 however, if desired, the anvil 120 may be biased (e.g. by a spring) to a position higher than that illustrated and movement of the sleeve 10 against the anvil 120 by the platens 66 and 68 moves the anvil 120 into its final predetermined position, e.g. against a stop (not shown).

The upper surface 124 of the anvil 120 (or anvil 216) is intended to be positioned to conform to the outside of the bevel fold 14 (or 18) when the adjacent side walls 22 and 24 are forced against the support surfaces 114 and 112 respectively and the sleeve 10 is squared.

Figure 7:
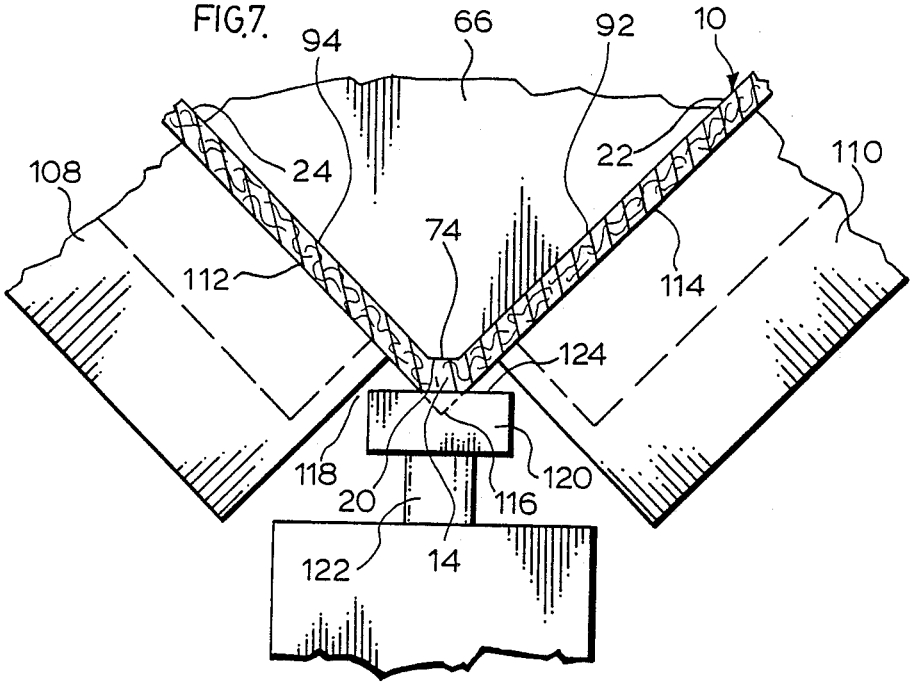
FIG. 7 is an enlarged sectional view of the support member positioned at the apex of the cradle.

The platen 66 (or 68) substantially conforms to the inside of the sleeve 10 across the fold 14 (or 18, etc.) with the end 74 of the platen substantially conforming with the surface 20 of the fold 14 and the sides 92 and 94 of the platen 66 (or 68) conforming with the inside of the walls 22 and 24 of the sleeve 10 when the sleeve 10 is in squared condition (see FIG. 7).

The movement of the platen 66 and 68 into and out of the ends of the sleeve 10 in the FIG. 3 embodiment is accomplished by mounting the platen 66 (or 68) (Only the support for platen 66 will be described it being apparent that the support for platen 68 is essentially the same.) on an arm 126 which is pivoted around pivot point 128 mounted on a suitable mounting block 130 by a piston and cylinder arrangements 132.

Movement of the support 100 as indicated by the arrow 102 moves the block 130 as well as the cradle portion 98 simultaneously so that the relationship of the platen 66 to the cradle 98 remains fixed regardless of the spacing between the cradle 98 and the cradle 96.

When the platen 66 (or 68) is moved into the sleeve 10 it extends at an angle relative to the longitudinal axis of the sleeve and as indicated at A in FIG. 4 so that the leading end 74 of the platen projects into the sleeve a short distance while the upper portion of the platen projects out of the sleeve. This permits an end closure pad such as the pad 26 to be applied at one axial end of the sleeve 10 as indicated at 130 in FIG. 4 and the platen 66 (or 68) remain substantially clear of the blank or pad 26 when so applied. The platen 66 (or 68) is however positioned sufficiently close to the axial end 130 of sleeve 10 to support the inside of walls 22 and 24 and prevent deflection when the flaps 30 and 32 of the pad are folded and pressed against the outside of the sleeve 10 by a mechanism such as the applicator 78 or its equivalent.

Movement of the platen 66 into and out of the sleeve 10 as indicated by the arrow 140 in FIGS. 3, 4 and 5 is obtained by pivoting on pivot point 128. The length of the arm 126 and height of the pivot 128 relative to the axis of the sleeve 10 insures the position of the platen 66 (or 68) is as desired within the sleeve 10 and permits the insertion (or withdrawal) of the platen 66 (or 68) when one or two pads 26 are secured at one (or both) axial end (or ends) of the sleeve 10.

Having described the invention, modifications will be evident to those skilled in the art without departing from the spirit of the invention as defined in the appended claims:

1. An apparatus for squaring a sleeve formed with at least one pair of opposed bevelled corners each interconnecting a pair of adjacent side walls of said sleeve, said apparatus comprising a cradle having supporting members converging toward an apex at substantially the same angle as said pair of adjacent side walls interconnected by one of said bevelled corners converge when said sleeve is in squared condition, said members terminating spaced from said apex to provide a space, an anvil in said space between said apex and said members, said anvil being in position to engage said one of said bevelled corners when said sleeve is in said cradle, a platen member, and means for moving said platen member into said sleeve and into said one bevelled corner when said sleeve is in said cradle, said platen member having an outer periphery conforming with the shape of the inside of said sleeve around said one bevelled corner when said sleeve is in said squared condition, said means for moving said platen into said one bevelled corner to force said one bevelled corner into face to face relationship with said anvil and each of said pair of adjacent side walls into face to face relationship with its adjacent said support member thereby to square said sleeve.

2. An apparatus as defined in claim wherein said platen member is positioned adjacent one axial open end of said sleeve, the apparatus further comprising means for applying an end closure pad to said open end of said sleeve when said sleeve has been squared and is clamped between said cradle and said platen member.

3. An apparatus as defined claim 2 wherein said end closure pad is provided with flaps and wherein said means to apply said end closure pad includes flap folding wings pivotably mounted to force said flaps one against an outside surface of each of said pair of adjacent side walls and said platen member is positioned adjacent said axial open end of said sleeve in position to support each of said pair of adjacent side walls from inside of said sleeve when said flaps are forced against said outside of said side walls.

4. An apparatus as defined in claim 3 wherein said means to move moves said platen into and out of said sleeve on a path that does not significantly interfere with an end closure pad after it is applied to the adjacent said open axial end of said sleeve.

5. An apparatus as defined in claim 1 wherein said sleeve is supported adjacent to both its axial ends in said cradle and wherein two of said platens are provided one adjacent to each axial end of said sleeve and said means to move moves both said platens into said bevelled corner one adjacent each axial end of said sleeve to square said sleeve.

6. An apparatus as defined in claim 2 wherein said sleeve is supported adjacent to both its axial ends in said cradle and wherein two of said platens are provided one adjacent to each axial end of said sleeve and said means to move moves both said platens into said one bevelled corner adjacent each axial end of said sleeve to square said sleeve.

7. An apparatus as defined in claim 3 wherein said sleeve is supported adjacent to both its axial ends in said cradle and wherein two of said platens are provided one adjacent to each axial end of said sleeve and said means to move moves both said platens into said one bevelled corner adjacent each axial end of said sleeve to square said sleeve.

8. An apparatus as defined in claim 4 wherein said sleeve is supported adjacent to both its axial ends in said cradle and wherein two of said platens are provided one adjacent to each axial end of said sleeve and said means to move moves both said platens into said one bevelled corner adjacent each axial end of said sleeve to square said sleeve.

* * * * *